US006382108B1

(12) United States Patent
Stanek et al.

(10) Patent No.: US 6,382,108 B1
(45) Date of Patent: May 7, 2002

(54) INTERMEDIATE BULK CONTAINER SPILL PALLET

(75) Inventors: Lawrence C. Stanek, Akron; Douglas M. Horner, Gates Mills; Scott R. Janda, Chagrin Falls, all of OH (US)

(73) Assignee: Polymer and Steel Technologies, Inc., Eastlake, OH (US)

( * ) Notice: Subject to any disclaimer, the term of this patent is extended or adjusted under 35 U.S.C. 154(b) by 0 days.

(21) Appl. No.: 09/813,874

(22) Filed: Mar. 21, 2001

(51) Int. Cl.[7] ..... B65D 19/44
(52) U.S. Cl. ..... 108/55.1; 206/386
(58) Field of Search ..... 108/51.11, 52.1, 108/53.1, 53.3, 55.1, 55.3, 55.5, 57.13, 57.18, 57.25, 24; 706/600, 386, 598, 595, 599; 220/571, 571.1, 572

(56) References Cited

U.S. PATENT DOCUMENTS 3,776,435 A * 12/1973 Smith
4,007,694 A * 2/1977 Fowler et al. ..... 108/55.1
4,838,178 A * 6/1989 Chriske et al. ..... 108/55.1
4,930,632 A * 6/1990 Eckert et al. ..... 108/55.1 X
5,020,667 A * 6/1991 Bush ..... 108/55.1 X
5,109,985 A * 5/1992 Rose ..... 108/55.1 X
5,133,460 A * 7/1992 Shueert ..... 108/55.1 X
5,249,699 A * 10/1993 Williams ..... 108/55.1 X
5,429,236 A * 7/1995 Evans ..... 108/55.1 X
5,579,700 A * 12/1996 Nuechterlein et al. ..... 108/55.1
RE35,875 E * 8/1998 Shuert ..... 108/55.1
6,311,628 B1 * 11/2001 Smith et al. ..... 108/55.1

* cited by examiner

*Primary Examiner*—Jose V. Chen
(74) *Attorney, Agent, or Firm*—Pearne & Gordon LLP

(57) ABSTRACT

A spill pallet for supporting and providing secondary containment for at least one intermediate bulk container. The spill pallet consists of a base and side walls that form an open-top box structure. From the base of each of the four corners of the structure extend four pillars with flat upper surfaces. These pillars support a platform that covers a substantial portion of the structure. The platform contains a center support post that extends to the base of the structure. The container and platform have been adapted so that they can be nested with other containers and platforms for shipping.

11 Claims, 4 Drawing Sheets

INTERMEDIATE BULK CONTAINER SPILL PALLET

BACKGROUND OF THE INVENTION

This invention relates to spill pallets and, more particularly, to spill pallets for intermediate bulk containers. Intermediate bulk containers are used to store and transport hazardous materials in accordance with Department of Transportation (DOT) and Environmental Protection Agency (EPA) rules. When these containers are stored, EPA rules, and particularly 40 C.F.R. §264.175, require that the container must have a containment system wherein a base must underlie the container which is free of cracks or gaps and which is sufficiently impervious to contain leaks, spills, and accumulated precipitation until the collected material is detected and removed. The base must be adapted to drain and remove accumulated liquids unless the container is suspended above the base. The containment system must also have sufficient capacity to contain the volume of the largest container or 10 percent of the volume of all of the containers above the base, whichever is larger.

A number of containment systems are in use for containing spillage from intermediate bulk containers. While at least one commercial system employs welded steel for the spill pallet or base, most systems employ polyethylene because of its chemical resistance. The spill capacity of the typical pallet is about 400 gallons, which corresponds to about one and one-half to two times the capacity of a typical intermediate bulk container.

A variety of techniques are employed to suspend the container above the base or pallet. One such system employs a steel platform having support legs straddling the pallet or resting on the bottom floor of the pallet. Other systems employ plastic pedestals resting on the bottom floor of the pallet.

There is a need for a containment system which conforms to the requirements of 40 C.F.R. §264.175 which is resistant to a wide range of chemicals, inexpensive to manufacture, and economical to ship to the customer. While many of the prior art pallets are nestable and stackable for shipping purposes, the equipment for supporting the container above the base or pallet is not nestable and requires additional shipping space. Typically, the container support is shipped assembled or disassembled in the pallet, thus rendering the pallet non-nestable.

BRIEF DESCRIPTION OF THE INVENTION

The invention provides a spill pallet assembly for intermediate bulk containers which complies with EPA rules, stores the container in an elevated position above the pallet and which is fully nestable for shipping purposes.

According to this invention, the spill pallet assembly comprises a base comprising a container having a bottom wall and a series of intersecting side walls. The bottom wall cooperates with the side walls to define an open-top box structure. The container defines a plurality of support pillars, with a pillar adjacent an intersection of each of the side walls. Each pillar has sides which extend upwardly from the bottom wall to a substantially flat upper pillar surface which is coplanar with each other such surface. A support platform substantially covers the box structure and is supported by the upper surfaces of the pillars. The support platform defines a center support post extending downwardly from the support platform to the bottom wall of the container. A grid may be provided on the upper surface of the support platform.

The support platform is provided with a downwardly extending peripheral skirt having portions thereof engaging sides of the pillars to minimize lateral shifting of the platform. The support platform is further provided with recesses which receive the flat upper surfaces of the pillars and which cooperate with the skirt portions to further minimize lateral shifting of the support platform.

DETAILED DESCRIPTION OF THE INVENTION

Figure 1:
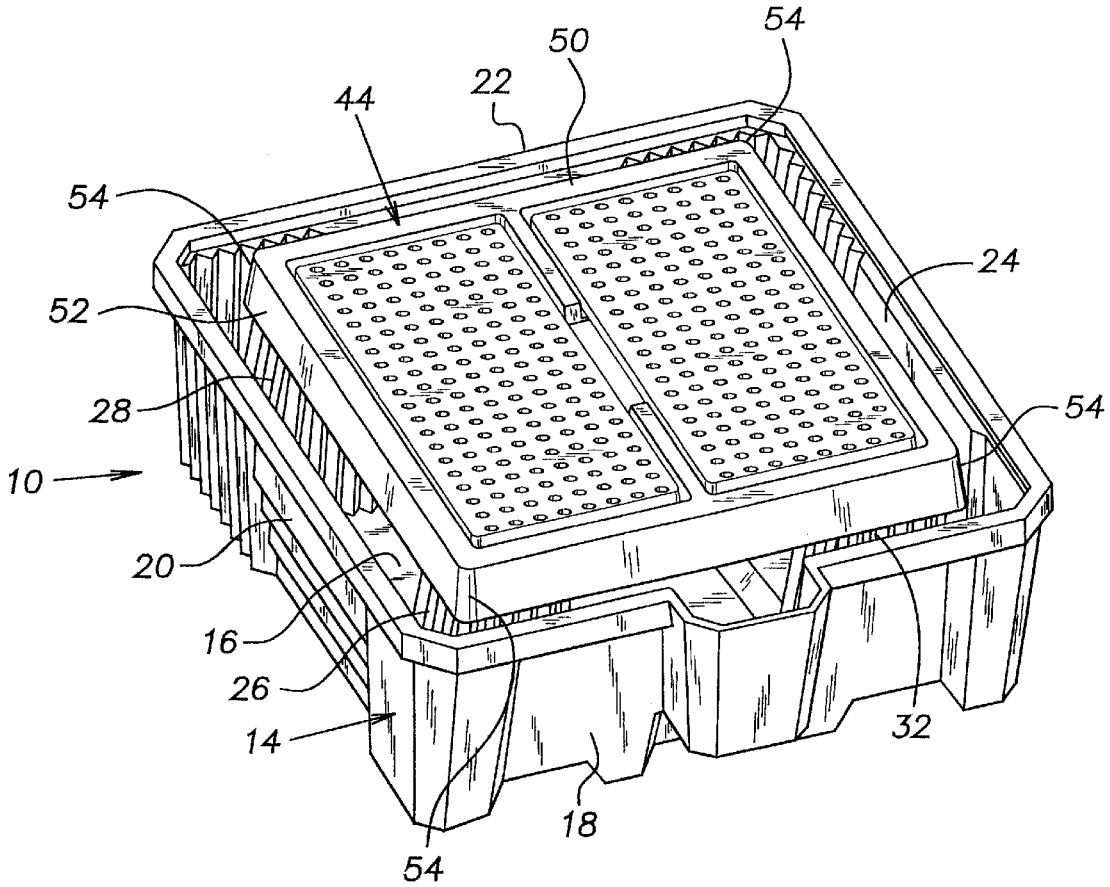
FIG. 1 is a perspective view of a spill pallet according to this invention.
Figure 2:
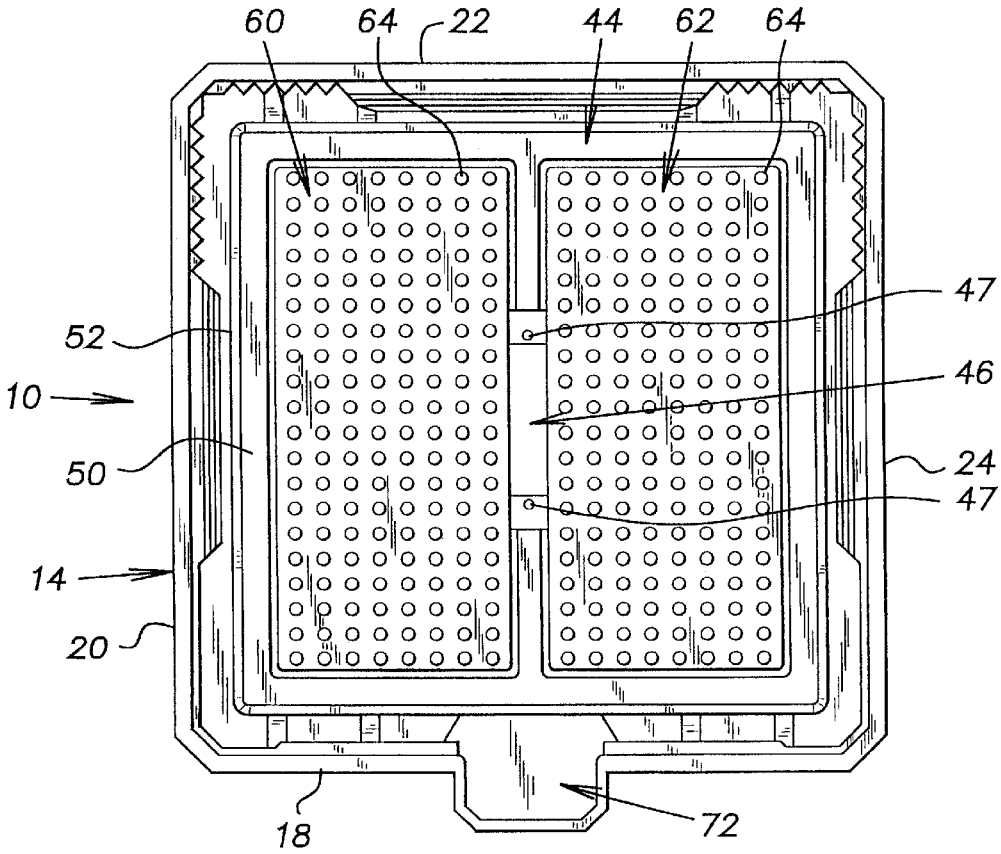
FIG. 2 is a top plan view of the spill pallet.
Figure 3:
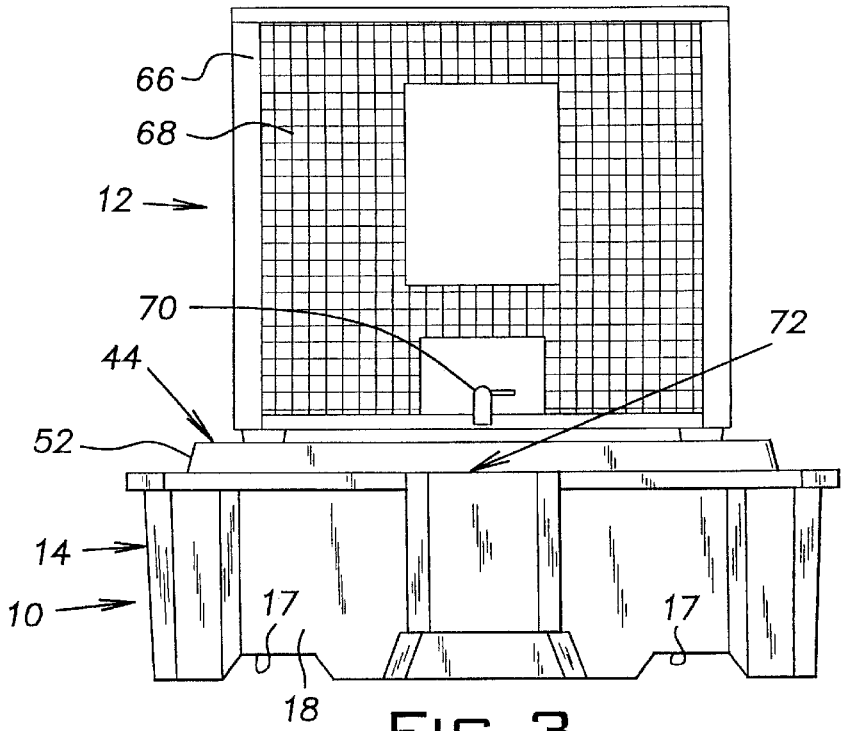
FIG. 3 is an elevational view of the spill pallet illustrating an intermediate bulk container in place on the pallet.

Referring now to the drawings, there is illustrated a spill pallet 10 for supporting and providing secondary containment for at least one intermediate bulk container 12 (FIG. 3). The pallet 10 includes a base 14 defined by a bottom wall 16 and a series of intersecting side walls 18, 20, 22, and 24. The bottom wall 16 and the side walls 18–24 cooperate to form an open-top box structure. The bottom wall 16 defines a pair of fork-lift entries 17 for convenient portability of the pallet 10.

Figure 4:
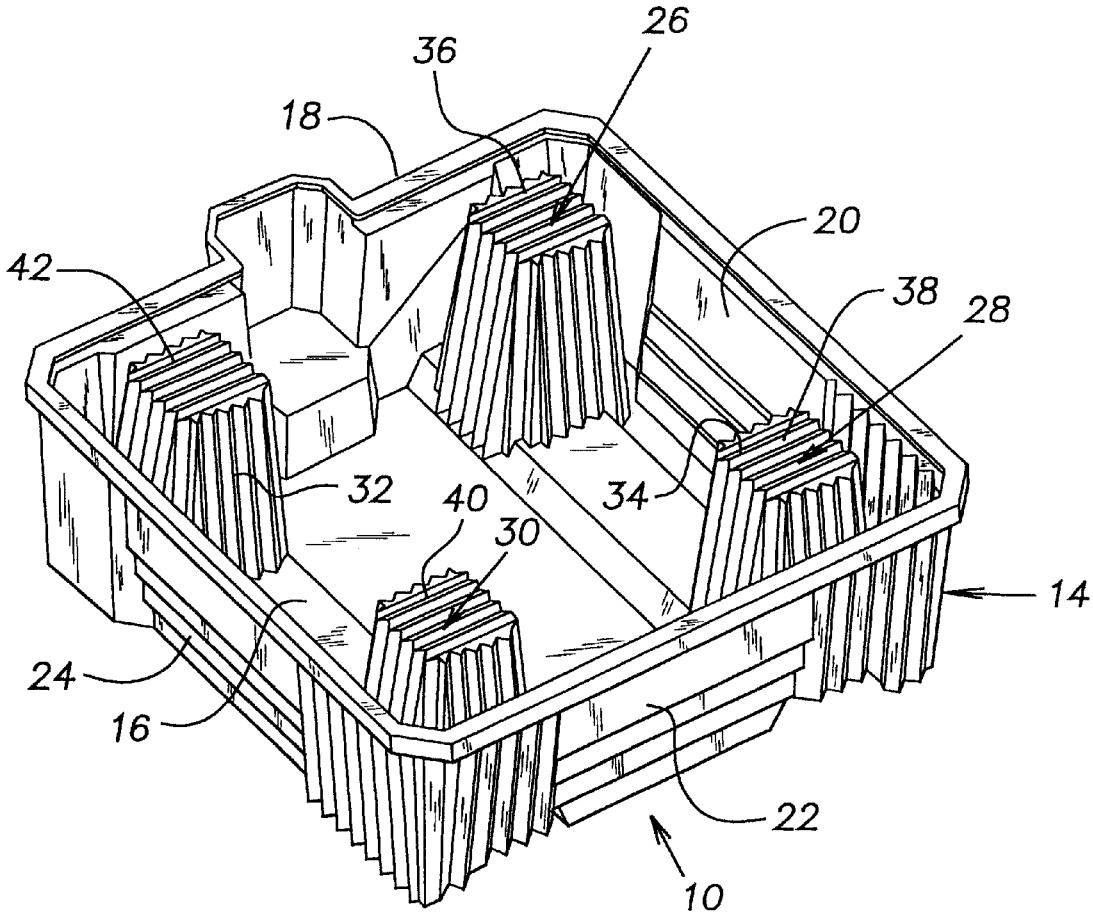
FIG. 4 is a perspective view of the base of the pallet with the support platform and grating removed.
Figure 5:
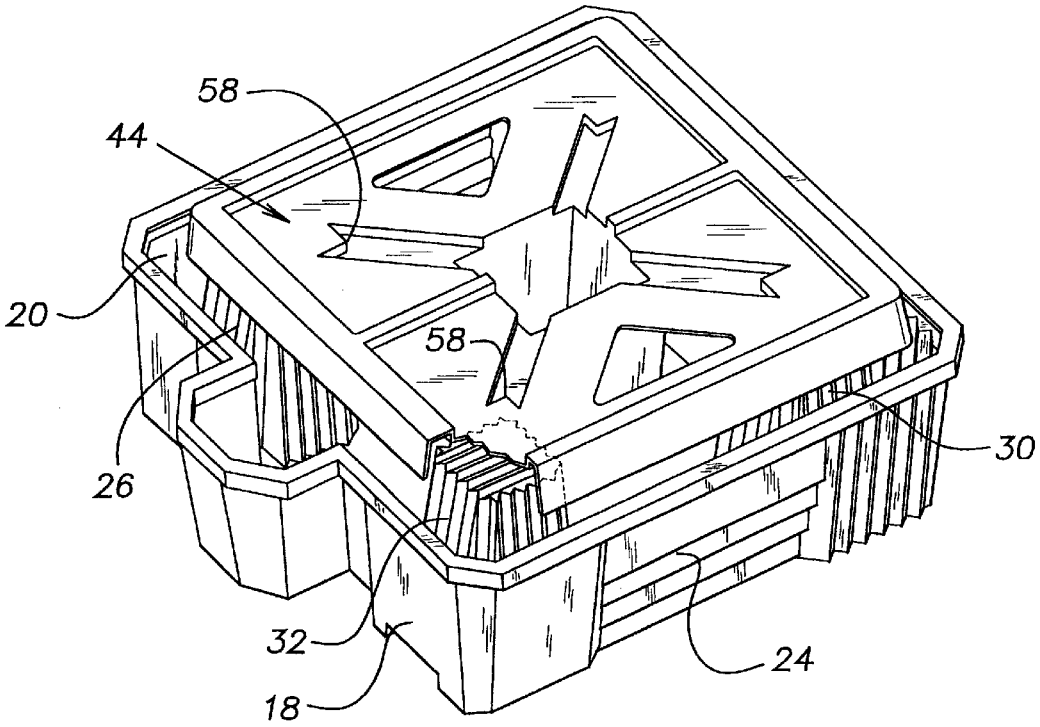
FIG. 5 is a perspective view of the spill pallet with the grating removed and with a portion of the platform broken away.
Figure 6:
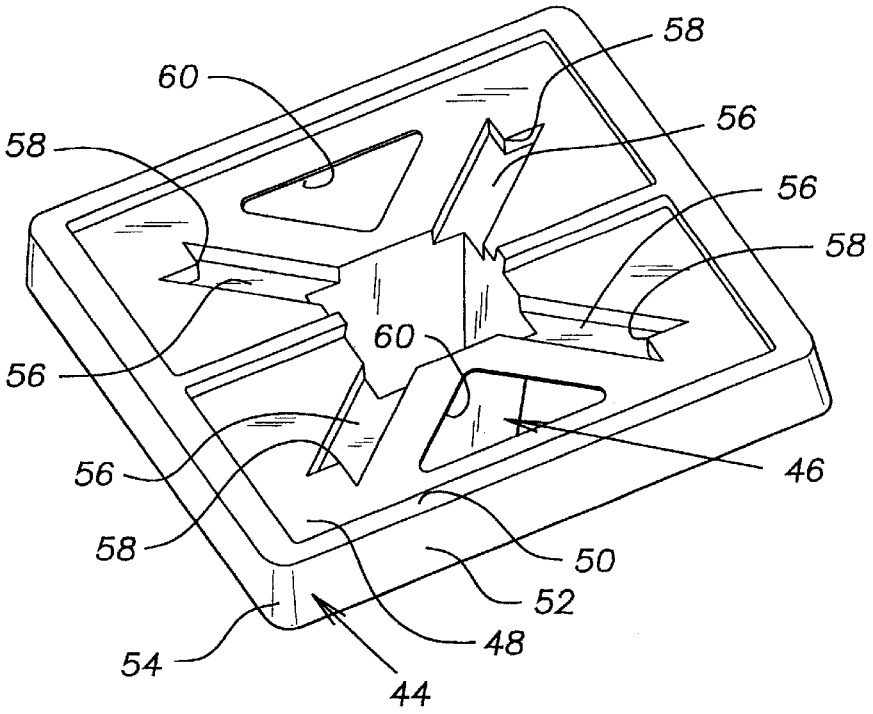
FIG. 6 is a perspective view of the support platform.

The pallet 10 is formed from polyethylene as a one-piece unit and a plurality of pillars 26, 28, 30, and 32 which form a continuation of and project upwardly from the bottom wall 16 to form pockets 34 (FIG. 4) extending into the bottom surface of the bottom wall 16. The pillars have substantially flat upper surfaces 36, 38, 40, and 42 which are substantially coplanar with each other.

A support platform 44 substantially covers the open top of the box structure formed by the base 14 and is supported by each upper surface 36–42 of the pillars 26–32. The support platform 44 defines a center support post 46 extending downwardly from an upper surface 48 of the platform 44 to the bottom wall 16. Drainage openings 47 are provided adjacent the bottom of the post 46. The upper surface 48 forms a peripheral curb 50 and a downwardly extending peripheral skirt 52. The peripheral skirt 52 has corners 54 which snugly engage two intersecting side walls of each of the pillars 26–32. A plurality of diagonal recesses 56 are provided in the upper surface 48. The recesses 56 have end portions 58 which are configured to engage other intersecting sidewalls of the pillars 26–32 to further minimize lateral shifting of the support platform 44. Drain openings 60 are provided in the platform 44 and the recesses 56 further serve to conduct any spillage to the interior of the post 46 and then to the base 14 through the openings 47.

A pair of gratings 60 and 62 are positioned on the support platform 44. Each grating 60 and 62 is provided with a multiplicity of apertures 64. The gratings support the intermediate bulk container 12 as shown in FIG. 3. Conventional bulk containers typically include a metal cage 66 and a plastic container 68 having a bottom tap 70. The sidewall 18 is formed to provide a bucket shelf 72 for placement of a bucket (not shown) thereon.

It should be noted that the sidewalls 18–24 are sloped and the bottom wall 16 is configured to permit nestability for shipping purposes. It should be further noted that the platform 44 and its support post 46 are adapted to be nested with other such platforms for shipping purposes.

While the invention has been shown and described with respect to particular embodiments thereof, those embodiments are for the purpose of illustration rather than limitation, and other variations and modifications of the specific embodiments herein described will be apparent to those skilled in the art, all within the intended spirit and scope of the invention. Accordingly, the invention is not to be limited in scope and effect to the specific embodiments herein described, nor in any other way that is inconsistent with the extent to which the progress in the art has been advanced by the invention.

What is claimed is:

1. A spill pallet for supporting and providing secondary containment for at least one intermediate bulk container comprising a base having a bottom wall and a series of intersecting side walls, said bottom wall cooperating with said side walls to define an open-top box structure, a support pillar adjacent an intersection of each of said side walls, each said support pillar having sides extending upwardly from said bottom wall and having a substantially flat upper surface which is substantially coplanar with each other flat upper surface, a support platform substantially covering said box structure and being supported by each said upper surface, said support platform defining a center support post extending downwardly from said support platform to said bottom wall.

2. A spill pallet according to claim 1 wherein the flat, upper surface of each pillar is spaced from its adjacent side walls.

3. A spill pallet according to claim 2 wherein said support platform has a downwardly extending peripheral skirt, said skirt having portions thereof engaging intersecting sidewalls of said pillars to minimize lateral shifting of said support platform.

4. A spill pallet according to claim 3 wherein said support platform includes recesses which engage other intersecting sidewalls of said pillars and which cooperate with said skirt portions to further minimize lateral shifting of said support platform.

5. A spill pallet according to claim 1 wherein said center support post is hollow and forms an open-top cavity with a top surface of said support platform.

6. A spill pallet according to claim 5 wherein drain openings are provided adjacent a bottom portion of said support post.

7. A spill pallet according to claim 6 wherein drain openings are provided in said top surface of said support platform.

8. A spill pallet according to claim 5 wherein the support platform is adapted to be nested with another such support platform for shipping.

9. A spill pallet according to claim 1 wherein said container is adapted to be nested with another such container for shipping.

10. A spill pallet according to claim 1 wherein a grate is supported by said support platform.

11. A spill pallet according to claim 1 wherein one of said side walls defines a bucket shelf.

* * * * *